US009791805B2

(12) United States Patent
Mashiki

(10) Patent No.: US 9,791,805 B2
(45) Date of Patent: Oct. 17, 2017

(54) DEVELOPING DEVICE, IMAGE FORMING APPARATUS, COIL ATTACHING METHOD TO DEVELOPING DEVICE

(71) Applicant: KYOCERA Document Solutions Inc., Osaka (JP)

(72) Inventor: Masami Mashiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/333,877

(22) Filed: Oct. 25, 2016

(65) Prior Publication Data

US 2017/0123342 A1 May 4, 2017

(30) Foreign Application Priority Data

Oct. 28, 2015 (JP) ..... 2015-211875

(51) Int. Cl.
*G03G 15/08* (2006.01)

(52) U.S. Cl.
CPC ..... *G03G 15/0824* (2013.01); *G03G 15/0889* (2013.01)

(58) Field of Classification Search
CPC ..... G03G 15/0829; G03G 15/0824
See application file for complete search history.

(56) References Cited

U.S. PATENT DOCUMENTS 4,147,127 A * 4/1979 Terashima ..... G03G 15/0853 118/689
4,195,260 A * 3/1980 Sakamoto ..... G03G 15/0849 118/689
4,515,292 A * 5/1985 Koos, Jr. ..... G03G 15/0889 118/689
2016/0036168 A1* 2/2016 Mashiki ..... H01F 27/255 439/607.01

FOREIGN PATENT DOCUMENTS

JP 56074278 A * 6/1981 ..... G03G 15/0853
JP S 61-51715 A 3/1986
JP 10282782 A * 10/1998

* cited by examiner

*Primary Examiner* — Walter L Lindsay, Jr.
*Assistant Examiner* — Arlene Heredia Ocasio
(74) *Attorney, Agent, or Firm* — Stein IP, LLC

(57) ABSTRACT

A developing device includes a developer container for storing developer containing carrier and toner, the developer container including a first compartment and a second compartment in which the developer is stirred and fed, a developing roller, and a sensor including a coil. A pair of communication portion is disposed on both ends in a longitudinal direction of the compartments. In addition, a gap is formed between the first compartment and the second compartment, and a part of the first compartment adjacent to the gap is a cylindrical portion through which the developer passes. A flat cable as a coil passes through the gap and is wound around the cylindrical portion so as to form a winding by overlapping both end portions of the flat cable in a state where terminals of wires are shifted by one pitch.

9 Claims, 9 Drawing Sheets

DEVELOPING DEVICE, IMAGE FORMING APPARATUS, COIL ATTACHING METHOD TO DEVELOPING DEVICE

INCORPORATION BY REFERENCE

This application is based upon and claims the benefit of priority from the corresponding Japanese Patent Application No. 2015-211875 filed Oct. 28, 2015, the entire contents of which are hereby incorporated by reference.

BACKGROUND

The present disclosure relates to a developing device for developing an electrostatic latent image using toner, and to an image forming apparatus including the developing device.

It is possible to make a coil using a flat cable. For example, there is known a toroidal coil, in which a flat cable is wound around a body of a toroidal core disposed on a printed substrate, and both ends of protruding wires of the flat cable are electrically connected to patterns of the printed substrate, so that the wires and the patterns constitute a winding around the body of the toroidal core.

There is an image forming apparatus such as a multifunction peripheral, a copier, a printer, or a facsimile machine, which performs printing using developer containing magnetic carrier and toner. This image forming apparatus consumes the toner as printing proceeds. An amount of the magnetic carrier does not change basically. When a ratio of the toner in the developer (a ratio of the toner to the carrier, toner density) decreases, it is necessary to replenish the toner.

In order to determine whether or not it is necessary to replenish the toner, a toner density sensor for detecting toner density is disposed in the developing device of the image forming apparatus. A coil may be used for this toner density sensor. When the toner is consumed so that the ratio of the magnetic carrier is increased, an inductance value of the coil is increased. An output of the toner density sensor has a value corresponding to the toner density. On the basis of a variation of the inductance value of the coil, the toner density may be measured, and it may be determined whether or not the toner replenishment is necessary. In other words, a variation of an amount of the magnetic carrier in the magnetic path is detected. Thus the toner density in the developer is measured.

In the known technique described above, a flat cable is used for the coil. However, the flat cable that is just stuck to a wall of the developing device does not function as the coil. Accordingly, there is a problem that the coil using a flat cable cannot be used for the developing device.

In addition, in the toner density detection, a variation of an amount of the magnetic carrier in the magnetic path is detected. Therefore it is difficult to use the coil with a fixed core such as a toroidal coil in the known technique described above for detection of the toner density. In addition, the developer must not contact with the toroidal coil or the substrate directly. Accordingly, when the toroidal coil of the known technique described above is disposed in the developing device, the toroidal coil must be disposed outside a container of the developing device. Only a part of the toroidal coil can be adjacent to the developer. A variation of the toner density cannot be detected correctly. The toroidal coil of the known technique described above cannot solve the above-mentioned problem.

SUMMARY

A developing device according to an aspect of the present disclosure includes a developer container, a first feeding member, a second feeding member, a developing roller, and a toner density sensor. The developer container stores developer containing carrier and toner. The first feeding member is disposed in a first compartment that is one of compartments disposed in the developer container, so as to stir and feed the developer along with a longitudinal direction of the developer container. The second feeding member is disposed in a second compartment that is the other of the compartments disposed in the developer container, so as to stir and feed the developer in the developer container in the opposite direction to the first feeding member. The developing roller is disposed in an upper part of the developer container so as to face an image carrier on which an electrostatic latent image is formed, and is supported by the developer container in a rotatable manner, so as to carry the developer on a surface. The toner density sensor is a sensor for detecting toner density in the developer and includes a coil. A pair of communication portion for connecting an end of the first compartment to an end of the second compartment is disposed on both ends in the longitudinal direction of the first compartment and the second compartment. A gap is formed between the first compartment and the second compartment inside the pair of communication portion in the longitudinal direction. A part of the first compartment adjacent to the gap is a cylindrical portion through which the first feeding member and the developer pass. The coil is a flat cable. The flat cable passes through the gap and is wound around the cylindrical portion so as to form a winding by overlapping both end portions of the flat cable in a state where terminals of wires are shifted by one pitch.

Further features and advantages of the present disclosure will become apparent from the description of embodiments given below.

DETAILED DESCRIPTION

Now, with reference to FIGS. 1 to 18, an embodiment of the present disclosure is described. In view of the above-mentioned problem, the present disclosure uses a flat cable for simply forming a coil for toner density detection, so as to accurately detect a toner density. In the following description, a printer 100 (corresponding to the image forming apparatus) including a developing device 1 is exemplified and described. However, elements such as structures and arrangements described in this embodiment are merely examples for description and should not be interpreted as limiting the scope of the disclosure.

(Outline of Image Forming Apparatus)

Figure 1:
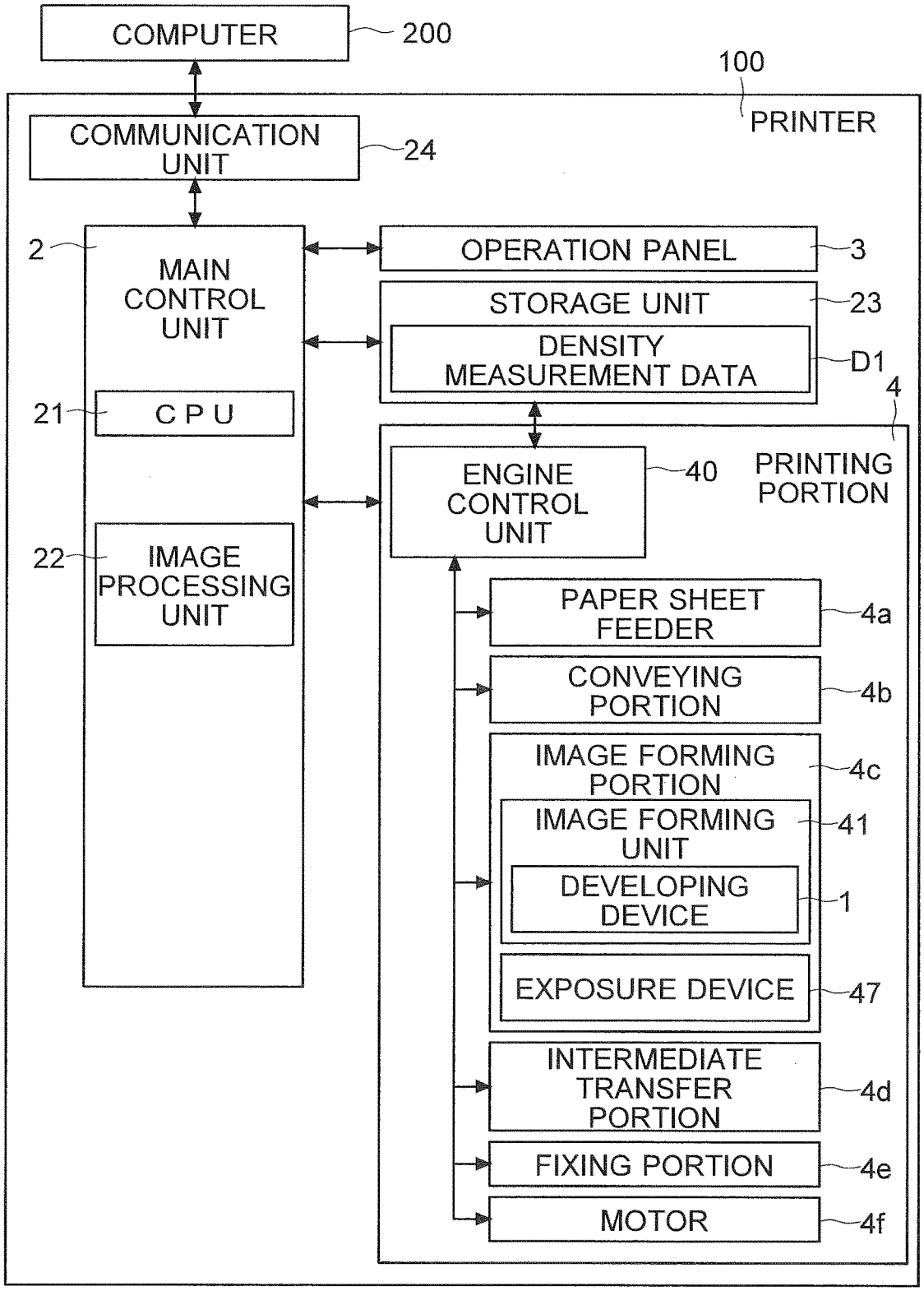
FIG. 1 is a diagram illustrating an example of a printer according to an embodiment.

With reference to FIG. 1, an outline of the printer 100 according to the embodiment is described. A main control unit 2 is disposed in the printer 100. The main control unit 2 controls operations of the printer 100. The main control unit 2 is a control boarde including a circuit such as a CPU 21 and an image processing unit 22. The CPU 21 performs various calculation processings based on programs and data stored in a storage unit 23. The CPU 21 controls individual portions of the printer 100. The image processing unit 22 performs image processing on image data based on print data sent from a computer 200 (received by a communication unit 24). The print data is data indicating setting for printing and content to be printed. The image processing unit 22 performs necessary image processing such as density conversion, scaling, or rotation.

The storage unit 23 is a combination of a nonvolatile storage device such as a ROM or an HDD and a volatile storage device such as a RAM. The storage unit 23 stores various data. The storage unit 23 stores various programs and data for controlling the printer 100, setting data, and image data.

The printer 100 includes an operation panel 3. The operation panel 3 includes a display panel and hardware keys. The display panel displays statuses of the printer 100, various messages, and various setting screens (for example, a liquid crystal or organic EL display). There are a plurality of hardware keys, which are used for setting operations. The main control unit 2 controls display on the operation panel 3. In addition, the main control unit 2 recognizes content of the setting operation to the operation panel 3. The main control unit 2 controls the printer 100 according to user's setting.

The printer 100 includes a printing portion 4. The printing portion 4 includes a paper sheet feeder 4*a*, a conveying portion 4*b*, an image forming portion 4*c*, an intermediate transfer portion 4*d*, and a fixing portion 4*e*. The printer 100 is provided with an engine control unit 40 (corresponding to the control unit). The engine control unit 40 actually controls operations of the paper sheet feeder 4*a*, the conveying portion 4*b*, the image forming portion 4*c*, the intermediate transfer portion 4*d*, and the fixing portion 4*e*. The engine control unit 40 is a substrate including a CPU and a memory. In addition, a plurality of motors 4*f* for rotating various rotating members in the printing portion 4 are disposed in the printer 100.

The main control unit 2 supplies data indicating content of a print job (a print instruction and image data) to the engine control unit 40. The engine control unit 40 controls operations of the paper sheet feeder 4*a*, the conveying portion 4*b*, the image forming portion 4*c*, the intermediate transfer portion 4*d*, the fixing portion 4*e*, and the motor 4*f*. The engine control unit 40 controls print-related processes such as feeding of the paper sheet, conveying of the paper sheet, forming of the toner image, transferring, fixing, the toner density detection, and the toner replenishment.

The engine control unit 40 controls the paper sheet feeder 4*a* to feed the paper sheets used for printing one by one. The engine control unit 40 controls the conveying portion 4*b* to convey the fed paper sheet. The engine control unit 40 controls the image forming portion 4*c* to form the toner image. The printer 100 supports color printing. The image forming portion 4*c* includes a plurality of image forming units 41. Specifically, an image forming unit 41Bk for forming a black toner image, an image forming unit 41C for forming a cyan toner image, an image forming unit 41Y for forming a yellow toner image, and an image forming unit 41M for forming a magenta toner image are disposed (see FIG. 2). The intermediate transfer portion 4*d* includes an intermediate transfer belt 42 (see FIG. 2). The intermediate transfer belt 42 receives primary transfer of each color toner image formed by each image forming unit 41. The engine control unit 40 controls the intermediate transfer belt 42 to rotate so that the toner images formed by the image forming portion 4*c* are primarily transferred onto the intermediate transfer belt 42. The engine control unit 40 controls the intermediate transfer portion 4*d* to perform secondary transfer of the toner images onto the conveyed paper sheet. The engine control unit 40 controls the fixing portion 4*e* to fix the toner image transferred onto the paper sheet.

(Each Image Forming Unit 41)

Figure 2:
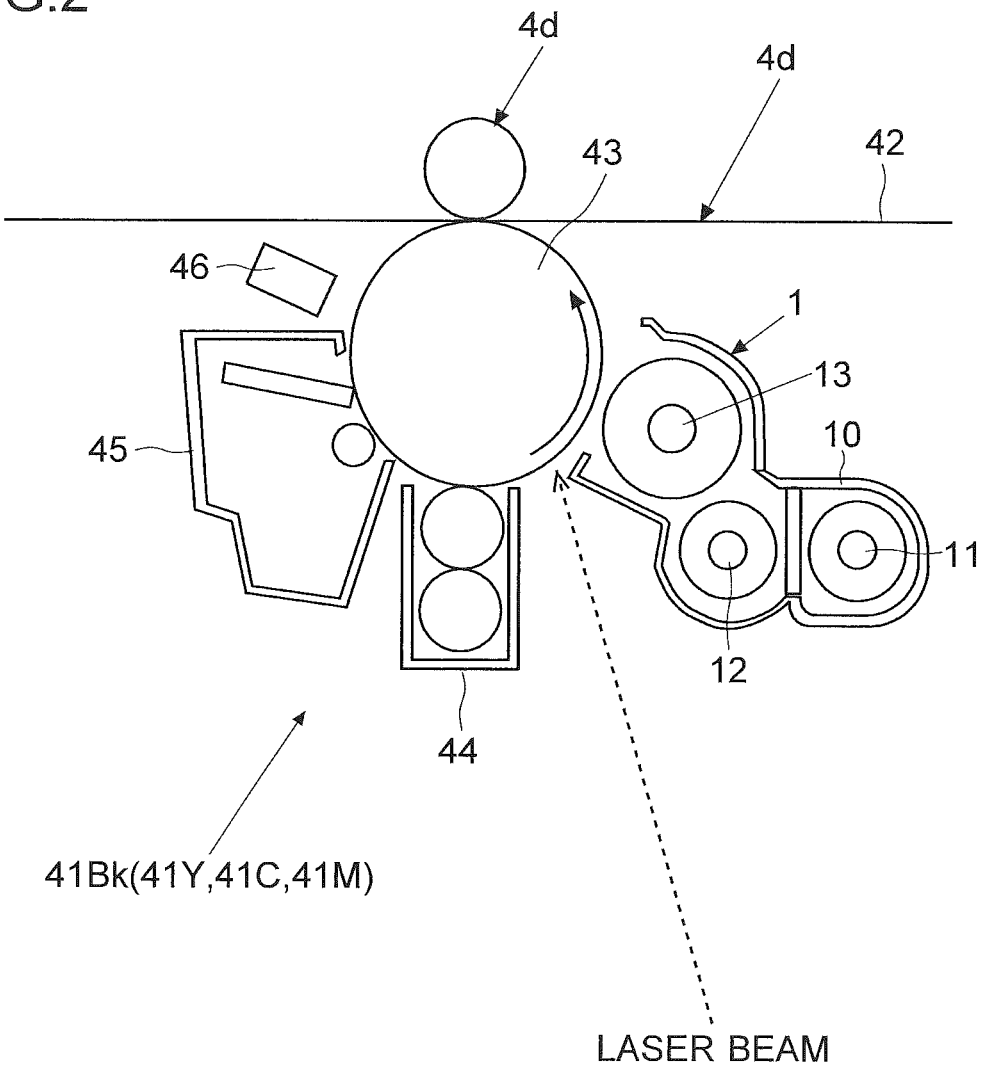
FIG. 2 is a diagram illustrating an example of each image forming unit according to the embodiment.

Next, with reference to FIG. 2, an example of each image forming unit 41 according to the embodiment is described. As described above, the image forming portion 4*c* includes the image forming units 41Bk, 41Y, 41C, and 41M for four colors. In addition, the printer 100 also includes an exposure device 47 (see FIG. 1). The exposure device 47 scans and exposes a photosensitive drum 43 of each image forming unit 41 with a laser beam.

The individual image forming units 41Bk to 41M form different colors of toner images, but they have the same structure. Accordingly, the image forming unit 41Bk for black color is exemplified and described below. Other image forming units 41 can be described in the same manner. For this reason, in the following description, the symbols Bk, Y, C, and M indicating colors are omitted unless otherwise noted. The same member is denoted by the same numeral or symbol in the image forming unit 41.

As illustrated in FIG. 2, each image forming unit 41 includes the photosensitive drum 43, the charging device 44, the developing device 1, a cleaning device 45, and a charge elimination device 46.

The engine control unit 40 controls the motor 4*f* (see FIG. 1) to rotate the photosensitive drum 43 at a predetermined circumferential speed. The photosensitive drum 43 undergoes charging, exposing, and developing processes so as to carry the toner image on the circumferential surface (image carrier). The engine control unit 40 controls the charging device 44 to charge the surface of the photosensitive drum 43 at a constant potential. The exposure device 47 is disposed below the image forming units 41. The engine control unit controls the exposure device 47 to emit the laser beam to the photosensitive drum 43. The exposure device 47 includes a semiconductor laser device (laser diode), a polygon mirror, a polygon motor 4*f*, and optical system members such as an fθ lens and a mirror (not shown). The exposure device 47 irradiates the charged photosensitive drum 43 with an optical signal (the laser beam illustrated in FIG. 2 by a broken line) based on an image signal obtained by dividing the image data into each color data using the optical system members. The photosensitive drum 43 is scanned and exposed. In this way, an electrostatic latent image according to the image data is formed on the circumferential surface of the photosensitive drum 43.

The developing device 1 includes a first feeding member 11, a second feeding member 12, and a developing roller 13. In addition, the developing device 1 has a housing (developer container 10) storing developer containing toner and magnetic carrier. The developer container 10 of the image forming unit 41Bk stores black developer, the developer container 10 of the image forming unit 41Y stores yellow developer, the developer container 10 of the image forming unit 41C stores cyan developer, and the developer container 10 of the image forming unit 41M stores magenta developer. Each developing device 1 is connected to a toner container 47 storing the toner of the corresponding color (see FIG. 3). Along with consumption of the toner, the toner is replenished from the toner container 47 to the developing device 1. Note that details of the developing device 1 are described later.

The engine control unit 40 controls the cleaning device 45 to clean the photosensitive drum 43. The cleaning device 45 scrapes the surface of the photosensitive drum 43 so as to remove the remaining toner and the like. In addition, the engine control unit 40 controls the charge elimination device 46 to emit light to the photosensitive drum 43 so as to eliminate the charge.

(Toner Replenishment)

Figure 3:
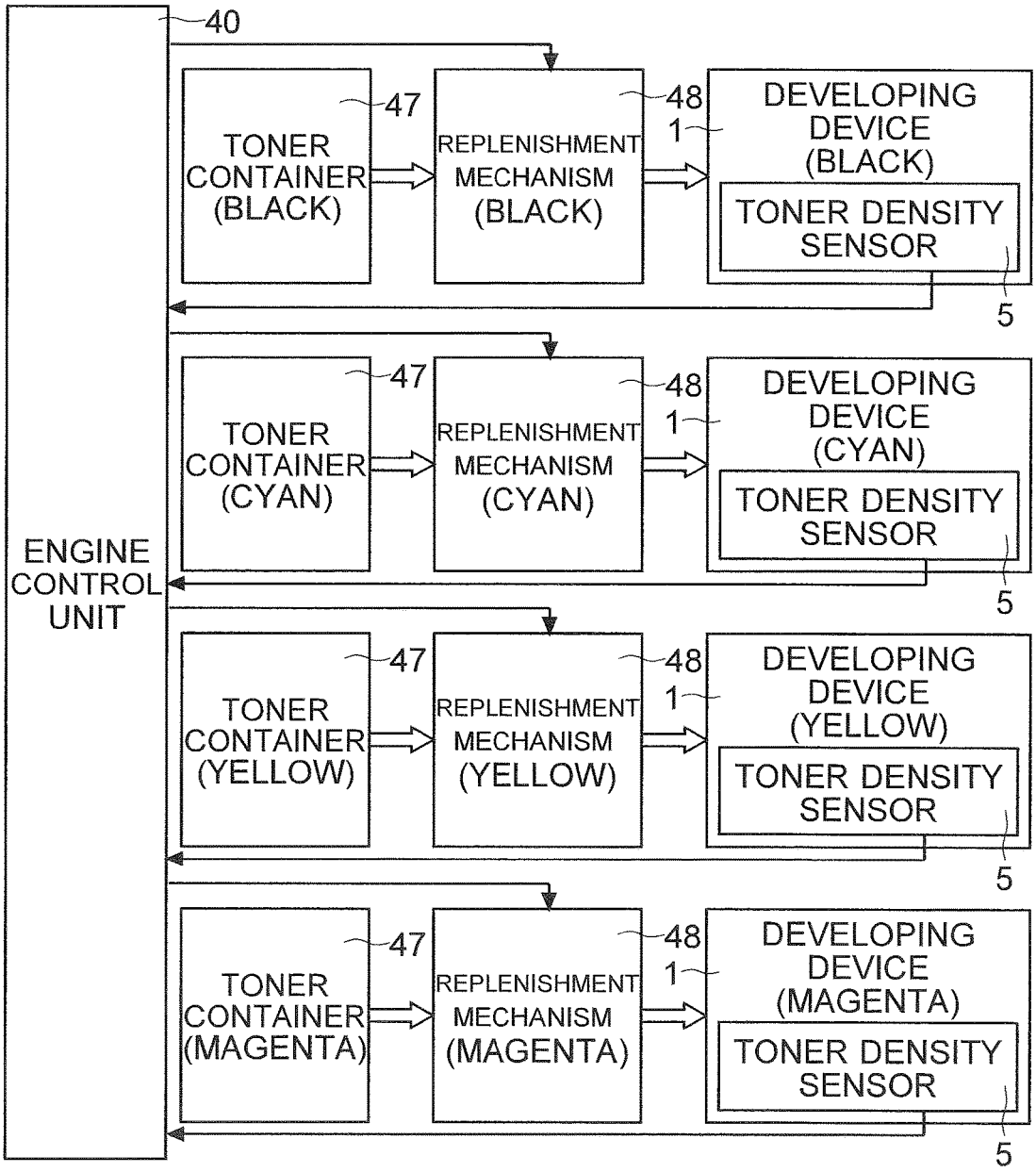
FIG. 3 is a diagram illustrating an example of a mechanism for replenishing toner to each developing device according to the embodiment.

Next, with reference to FIG. 3, replenishment of toner to each developing device 1 is described. Note that flows of toner are shown by white arrows in FIG. 3.

The toner container 47 and the replenishment mechanism 48 are disposed for each toner color in the printer 100. The toner container 47 stores replenishment toner. The replenishment mechanism 48 feeds the toner from the toner container 47 to the developing device 1. Along with printing, the magnetic carrier may also be decreased gradually. A trace amount of the magnetic carrier may be mixed into the toner container 47. In addition, a toner density sensor 5 is disposed in each developing device 1. In order to check whether or not the toner density is a specified value or more, the toner density sensor 5 detects the toner density in the developing device 1 (a ratio of the toner in the developer).

Total four toner containers 47 for black, cyan, yellow, and magenta colors are attached to the printer 100. Each toner container 47 is exchangeable. An empty toner container 47 is replaced. Each replenishment mechanism 48 includes a feed screw (not shown), a motor and a gear for rotating the feed screw (not shown). The feed screw feeds the toner from the toner container 47 to the developing device 1. One replenishment mechanism 48 is provided to the toner container 47 (the developing device 1). One toner density sensor 5 is provided to each developing device 1.

An output of each toner density sensor 5 is input to the engine control unit 40. The engine control unit 40 checks whether or not there is the developing device 1 having a toner density (a ratio of the toner in the developer, a ratio between the carrier and the toner) that is smaller than the specified value based on an output of each toner density sensor 5, when a predetermined density is detected. For example, the time when the predetermined density is detected is a time when the main power is turned on, when returning to the normal mode, during performing printing, before the print job is started, or when the print job is finished. The engine control unit 40 controls the replenishment mechanism 48 corresponding to the developing device 1 having a toner density smaller than the specified value to operate (to perform the replenishment). For example, when it is confirmed that the toner amount has reached the specified value or more based on an output of the toner density sensor 5, the engine control unit 40 controls the replenishment mechanism 48 to stop.

(Toner Density Sensor 5)

Figure 4:
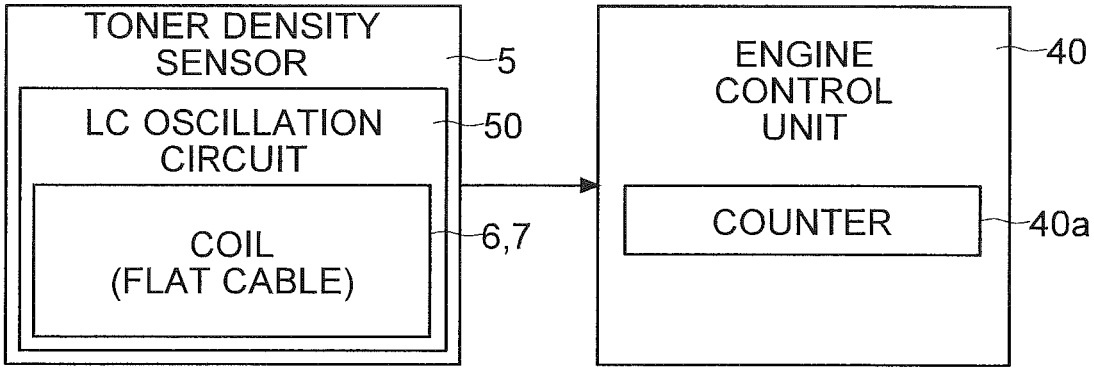
FIG. 4 is a diagram illustrating an example of a toner density sensor according to the embodiment.
Figure 5:
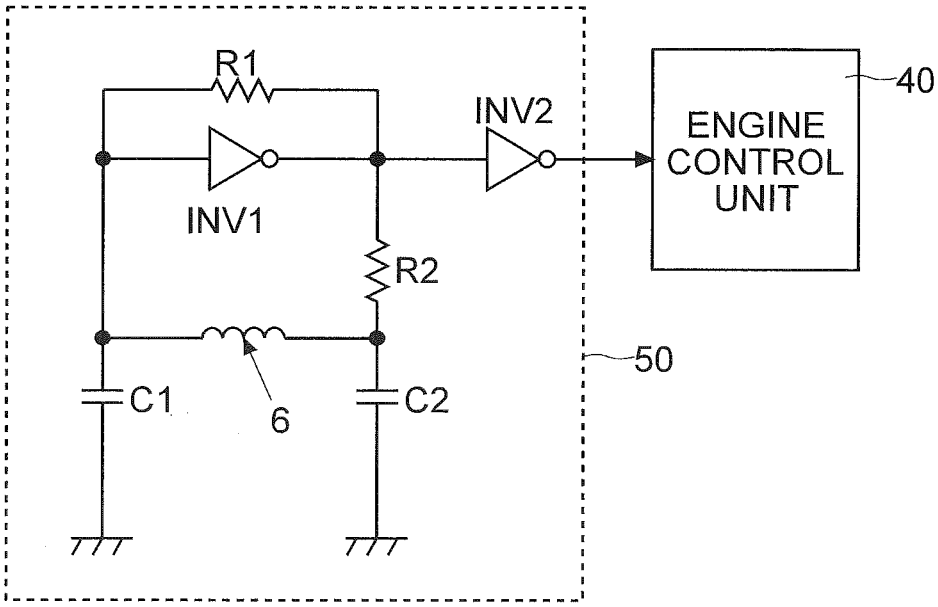
FIG. 5 is a diagram illustrating an example of an LC oscillation circuit according to the embodiment.

Next, with reference to FIGS. 4 and 5, the toner density sensor 5 according to the embodiment is described. As illustrated in FIG. 4, the toner density sensor 5 includes an LC oscillation circuit 50 (corresponding to an oscillation circuit). In order to detect the toner density in the developer, the LC oscillation circuit 50 includes a coil 6 using a flat cable 7 (details will be described later). The output of the toner density sensor 5 (the LC oscillation circuit 50) is input to the engine control unit 40. The engine control unit 40 detects the toner density in the developer based on a frequency of the LC oscillation circuit 50.

FIG. 5 illustrates an example of the LC oscillation circuit 50. The LC oscillation circuit 50 includes the coil 6, a first resistor R1, a second resistor R2, a first capacitor C1, a second capacitor C2, a first inverter INV1, and a second inverter INV2. The LC oscillation circuit 50 illustrated in FIG. 5 is one type of a Colpitts oscillator circuit.

As illustrated in FIG. 5, one of terminals of the coil 6 is connected to one terminal of the first capacitor C1, an input terminal of the first inverter INV1, and one terminal of the first resistor R1. The other terminal of the coil 6 is connected to one terminal of the second capacitor C2 and one terminal of the second resistor R2. The other terminal of the first capacitor C1 and the other terminal of the second capacitor C2 are connected to a ground. An output terminal of the first inverter INV1 is connected to the other terminal of the first resistor R1, the other terminal of the second resistor R2, and an input terminal of the second inverter INV2. An output of the second inverter INV2 is input to the engine control unit 40.

The second resistor R2, the first capacitor C1, the second capacitor C2, and the coil 6 of a negative feedback circuit changes the phase by 180 degrees, and hence the negative feedback becomes a positive feedback so that oscillation occurs. An oscillation frequency is $f=\frac{1}{2}\pi(LC)^{1/2}$). A sine wave is input to the second inverter INV2. The second inverter INV2 converts the input sine wave into a rectangular wave.

An inductance of the coil 6 varies according to the ratio between the magnetic carrier and the toner in the developer. When the toner is consumed so that the ratio of the magnetic carrier in the developer is increased, the inductance of the coil 6 increases. As the ratio (density) of the magnetic carrier in the developer is larger, the denominator of the above equation becomes larger. As a result, the frequency of an output signal of the LC oscillation circuit 50 (second inverter INV2) becomes lower. On the contrary, as the ratio of the magnetic carrier in the developer is smaller, the denominator of the above equation becomes smaller. As a result, the frequency of the output signal of the LC oscillation circuit 50 becomes higher.

A counter 40*a* (see FIG. 4) is disposed in the engine control unit 40. The counter 40*a* counts the number of pulses of an output (rectangular wave) of the second inverter INV2 during a predetermined count period. The count period is a period during which each feeding member rotates one or more turns, for example. The storage unit 23 stores density measurement data D1, which defines the ratio of the toner in the developer (toner density) with respect to the number of pulses during the count period (see FIG. 1). The engine control unit 40 refers to a count value of the counter 40*a* and the density measurement data D1. The engine control unit 40 selects toner density corresponding to the recognized count value from the density measurement data D1. The engine control unit 40 recognizes the selected toner density as a current toner density in the developer. The engine control unit 40 recognizes the toner density in the developer based on the frequency of the LC oscillation circuit 50. Then, the engine control unit 40 controls the replenishment mechanism 48 to replenish toner to the developing device 1 of a color of which the recognized toner density is the specified value or smaller.

(Developing Device 1)

Figure 6:
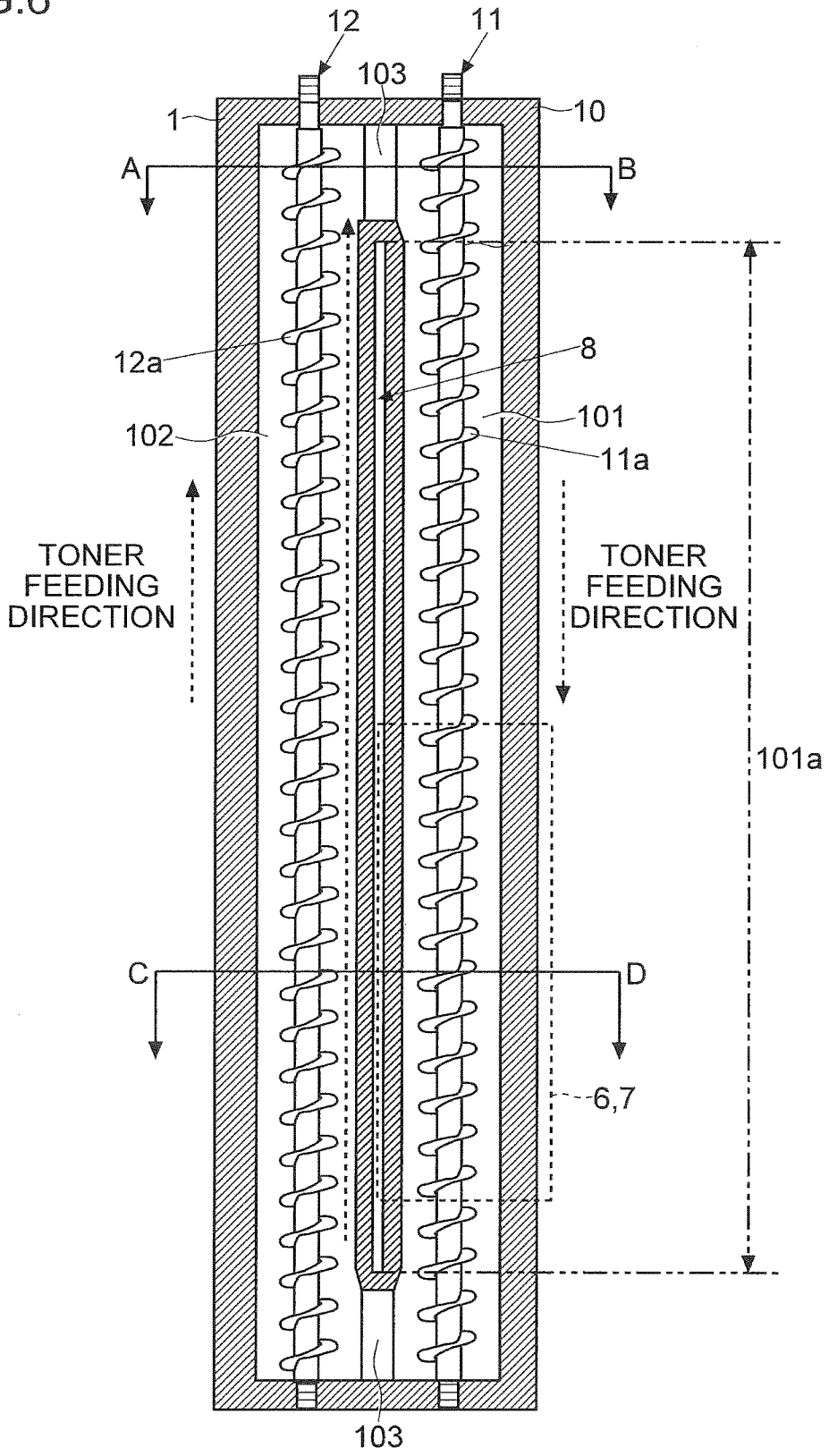
FIG. 6 is a cross-sectional view in a horizontal direction of the developing device according to the embodiment.
Figure 7:
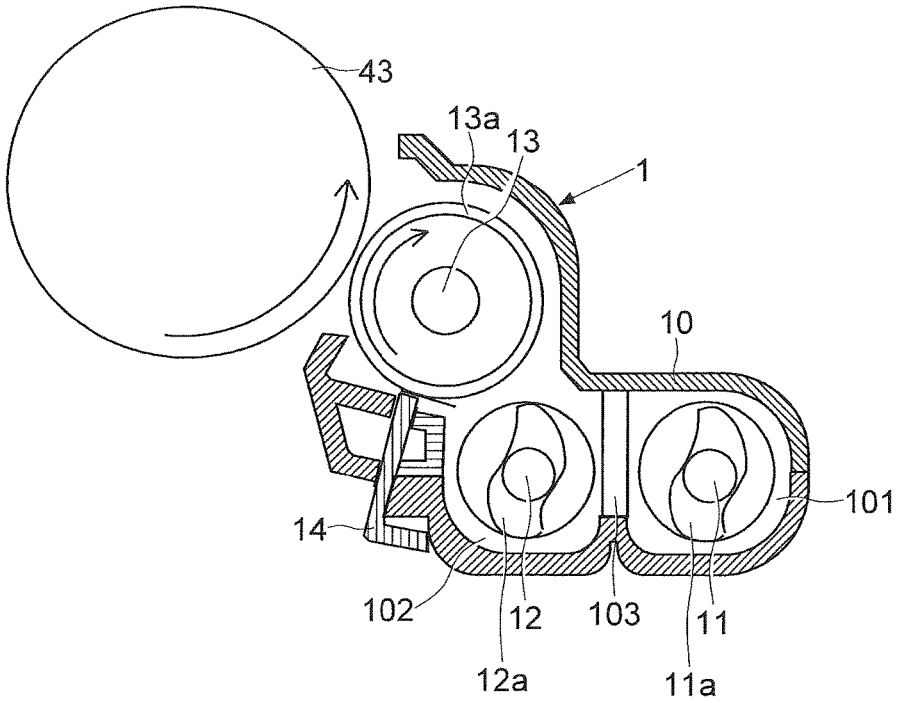
FIG. 7 is a cross-sectional view of the developing device according to the embodiment taken along an A-B line in FIG. 6.
Figure 8:
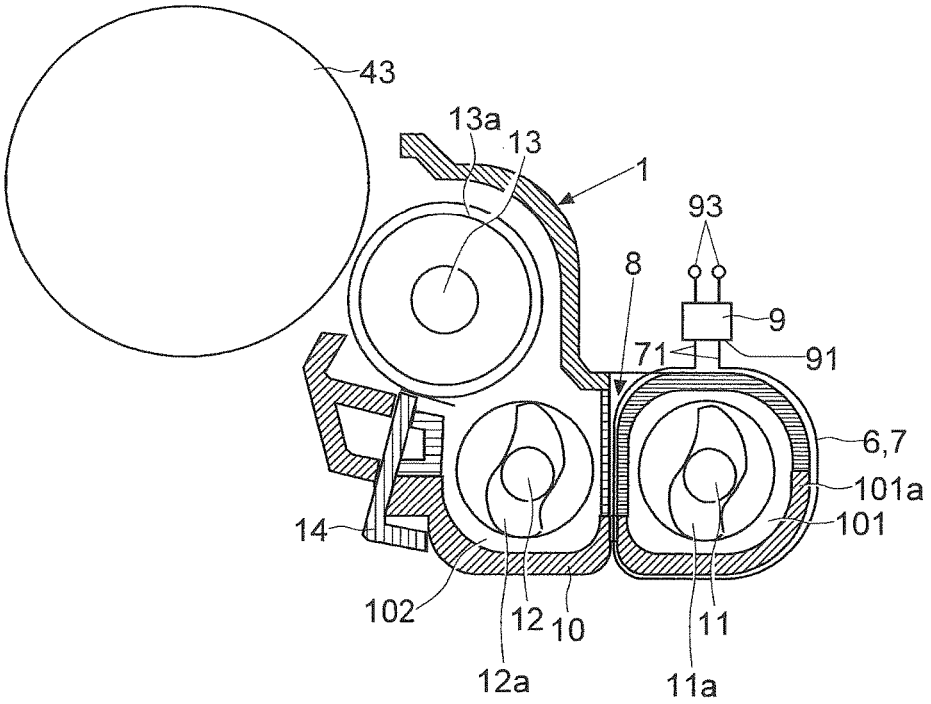
FIG. 8 is a cross-sectional view of the developing device according to the embodiment taken along a C-D line in FIG. 6.

Next, with reference to FIGS. 6 to 8, the developing device 1 according to the embodiment is described. In the following description, the developing device 1 is described, and the developing devices 1 of the individual image forming units 41 have the same structure and operation. The individual developing devices 1 can be described in the same manner, and the symbols for distinguishing colors are omitted.

As illustrated in FIGS. 6 to 8, the developing device 1 includes the developer container 10. The developer container 10 stores the developer containing the carrier and the toner. The developer container 10 is a case (outer shell) of the developing device 1. A lower part of the developer container 10 is divided into a first compartment 101 and a second compartment 102. FIG. 6 is a diagram of the developing device 1 viewed from below, and is a cross-sectional view in the horizontal direction at a part of the first compartment 101 and the second compartment 102. As illustrated in FIG. 6, the first compartment 101 is a compartment for stirring and feeding the developer. The second compartment 102 is a compartment for feeding the developer to the developing roller 13. A gap 8 (hollow part) is formed between the compartments.

The first feeding member 11 is disposed in one of the compartments (first compartment 101) of the developer container 10. The second feeding member 12 is disposed in the other compartment (second compartment 102) of the developer container 10. The first feeding member 11 includes a helical impeller 11*a* formed around a cylindrical rotation shaft. The second feeding member 12 includes a helical impeller 12*a* formed around a cylindrical rotation shaft. The first feeding member 11 and the second feeding member 12 rotate. Each feeding member is a screw that stirs and feeds the developer along the longitudinal direction of the developer container 10. The toner is electrified by friction in stirring. The first feeding member 11 and the second feeding member 12 have different developer feeding directions (FIG. 6 shows an example of a developer feeding direction by a broken line arrow). The second feeding member 12 closer to the developing roller 13 feeds the developer to the developing roller 13.

As illustrated in FIG. 6, a pair of communication portion 103 is disposed on both ends in the longitudinal direction of the first compartment 101 and the second compartment 102. The pair of communication portion 103 connects the end of the first compartment 101 to the end of the second compartment 102. The developer that reaches the end of the compartment passes through the pair of communication portion 103 so as to flow into the neighboring compartment. The first feeding member 11 and the second feeding member 12 stir and feed the developer so that the developer circulates in the developer container 10.

The developing roller 13 is disposed in the developer container 10. The developing roller 13 is disposed in an upper part of the developer container 10 (above the second feeding member 12) (see FIGS. 7 and 8). The developing roller 13 faces the image carrier (photosensitive drum 43) on which the electrostatic latent image formed, on an opening side of the developer container 10. A predetermined space is formed between the developing roller 13 and the photosensitive drum 43. The developing roller 13 carries the developer on the surface. The developing roller 13 supplies the toner to the photosensitive drum 43 at the area facing the photosensitive drum 43. The toner is replenished to the first compartment 101 via a toner replenishment opening (not shown). The replenishment mechanism 48 replenishes the toner to the first compartment 101.

The developing roller 13 includes a rotating cylindrical non-magnetic developing sleeve 13*a* (see FIGS. 7 and 8). The developing sleeve 13*a* includes a fixture magnet body (not shown) having a plurality of magnetic poles. As the fixture magnet body, there are disposed a restricting magnetic pole (not shown) formed of an N-pole, a conveying magnetic pole (not shown) formed of an S-pole, a main magnetic pole (not shown) formed of an N-pole, and a peeling magnetic pole (not shown) formed of an N-pole, in the developing sleeve 13*a*.

A bristle cutting blade 14 is attached to the developer container 10. The bristle cutting blade 14 restricts a thickness of the developer carried by the developing roller 13 and is attached along the longitudinal direction of the developing roller 13 (see FIGS. 7 and 8). The bristle cutting blade 14 is disposed on an upstream side of the position at which the developing roller 13 faces the photosensitive drum 43 in a rotation direction of the developing roller 13. A tiny gap is formed between the distal end of the bristle cutting blade 14 and the surface of the developing roller 13.

During the development process, a high voltage supply circuit (not shown) applies a DC bias voltage and an AC bias voltage to the developing roller 13. The toner in the developer is electrified in the process of stirring and circulating the developer by the feeding members. The second feeding member 12 feeds the developer in the second compartment 102 to the developing roller 13. Thus, a magnetic brush (not shown) is formed on the developing roller 13. A layer thickness of the magnetic brush is restricted by the bristle cutting blade 14, and then the magnetic brush is fed by rotation of the developing roller 13 to a part in which the developing roller 13 faces the photosensitive drum 43. When the DC bias voltage and the AC bias voltage are applied, the toner flies from the developing roller 13 to the photosensitive drum 43. The electrostatic latent image on the photosensitive drum 43 is developed.

(Coil 6 Using Flat Cable 7)

Next, with reference to FIGS. 6 and 8 to 12, the coil 6 using the flat cable 7 according to the embodiment is described. As described above, the pair of communication portion 103 is disposed on both ends in the longitudinal direction of the first compartment 101 and the second compartment 102 of the developer container 10. On the other hand, as illustrated in FIGS. 6 and 8, the gap 8 is formed between the first compartment 101 and the second compartment 102 inside the pair of communication portion 103 in the longitudinal direction. Because of this gap 8, the first compartment 101 has a cylindrical shape except for parts adjacent to the pair of communication portion 103 in the longitudinal direction. In other words, a part of the first compartment 101, which is adjacent to the gap 8, has a cylindrical shape. The first feeding member 11 and the developer pass through this cylinder, and the flat cable 7 can be wound around this cylinder.

Figure 11:
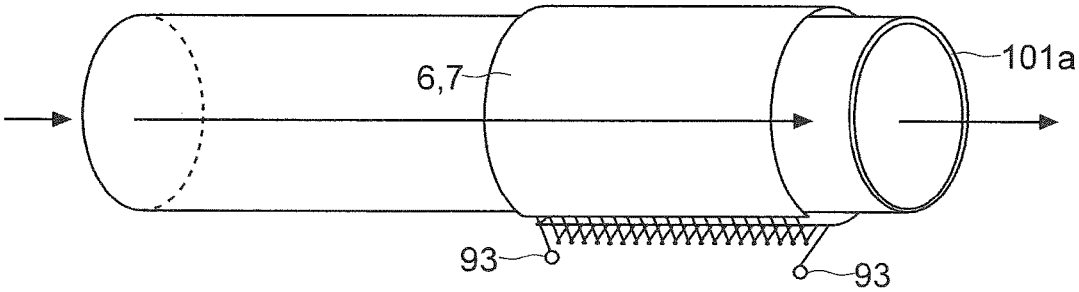
FIG. 11 is a diagram illustrating a flow of developer in a cylindrical portion and the flat cable wound around the cylindrical portion according to the embodiment.

The flat cable 7 can be inserted into the gap 8. As illustrated in FIGS. 8 and 11, the flat cable 7 is wound around a cylindrical portion 101*a* (the first compartment 101) so that wires 71 are orthogonal to the developer feeding direction. In other words, the gap 8 (hollow part) between the first compartment 101 and the second compartment 102 as well as the cylindrical portion 101*a* is formed so that the flat cable 7 can be wound around the first compartment 101.

Figure 9:
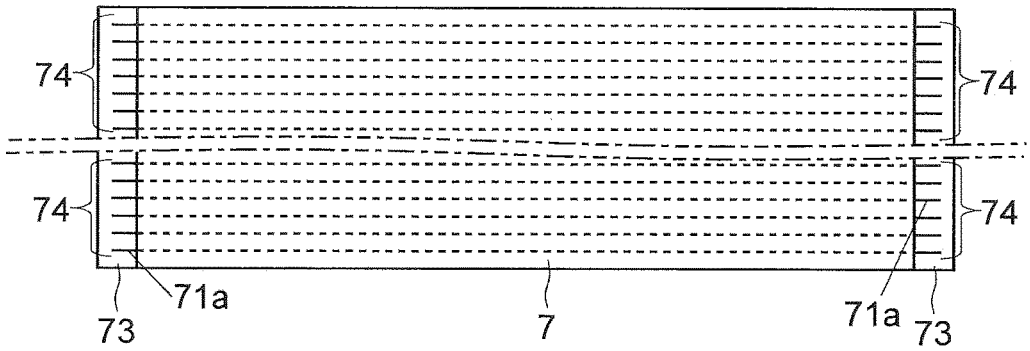
FIG. 9 is a diagram illustrating an example of a flat cable according to the embodiment.
Figure 10:
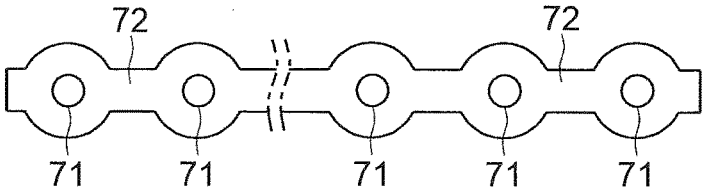
FIG. 10 is a cross-sectional view of the flat cable according to the embodiment.

With reference to FIGS. 9 and 10, the flat cable 7 is described. The flat cable 7 is a band-like cable in which a plurality of wires 71 are arranged. As illustrated in FIG. 9, the wires 71 of the flat cable 7 are arranged in parallel. As illustrated in FIG. 10, the wires 71 are coated with insulation material 72. In addition, neighboring wires 71 are parallel to each other. In FIG. 9, the wires in the insulation material 72 are shown by broken lines.

As illustrated in FIG. 9, terminal parts 74 are disposed on both end portions 73 of the flat cable 7. The terminal part 74 is a part in which the wires 71 are exposed as terminals or terminals 71*a* connected to the wires 71 are arranged. For example, coating of the insulation material 72 is peeled on one side of the flat cable 7. Note that only one of the arranged terminals 71*a* is denoted by numeral in each diagram for convenience sake.

FIG. 11 illustrates the cylindrical portion 101*a* of the developer container 10 schematically as a cylinder. FIG. 11 shows the developer feeding direction by solid line arrows. Note that the first feeding member 11 is not shown in FIG. 11.

As illustrated in FIG. 11, the flat cable 7 is inserted into the gap 8. In addition, the flat cable 7 is wound around the cylindrical portion 101*a* so as to form a winding. The terminals 71*a* of the wires 71 are connected with being shifted by one pitch. By shifting the terminals 71*a* of the wires 71, the flat cable 7 forms a coil 6 (winding). In other words, the flat cable 7 functions as the coil 6.

As illustrated in FIG. 11, the flat cable 7 is wound around the cylindrical portion 101*a*. In this way, the direction of each wire 71 of the flat cable 7 is perpendicular or substantially perpendicular (within a tolerance) to the developer feeding direction (the longitudinal direction of the first compartment 101, the rotation axis direction of the first feeding member 11). In this way, the carrier in the developer corresponds to a core of the cylindrical coil 6.

Figure 12:
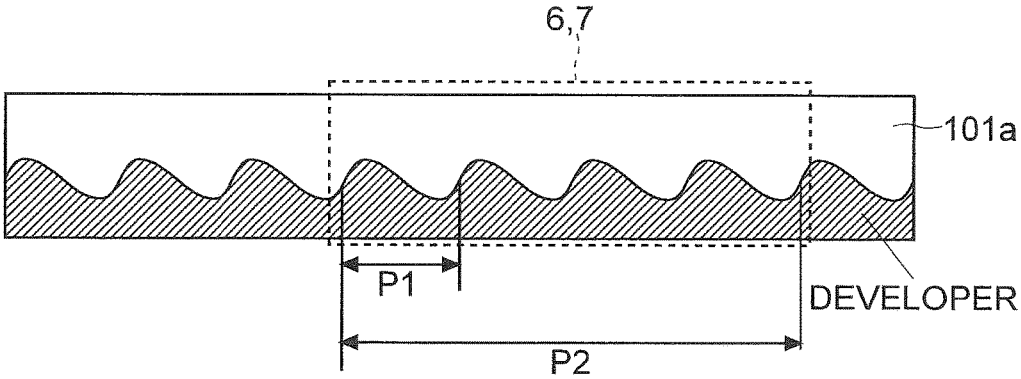
FIG. 12 is a diagram illustrating an example of a developer distribution state in the cylindrical portion of the developing device according to the embodiment.

FIG. 12 is a diagram illustrating a typical cross section of the cylindrical portion 101*a* viewed in the horizontal direction. The first feeding member 11 has the helical impeller 11*a*. Therefore the height of the developer in the cylindrical portion 101*a* is not even. As illustrated in FIG. 12, in the longitudinal direction of the first compartment 101 (the rotation axis direction of the first feeding member 11), a rolling (wave) appears in the height of the developer. The height of the developer in the first compartment 101 varies depending on places. It is experimentally known that a pitch P1 of the wave in the longitudinal direction of the first compartment 101 is close to the pitch of the helical impeller 11*a* in the rotation axis direction of the first feeding member 11 (an interval between neighboring blades in the rotation axis direction).

In order to decrease an error between the detected toner density and an actual toner density, it is preferred that an amount of the developer within the wiring of the coil 6 should not largely change. Therefore, as illustrated in FIG. 12, the width of the flat cable 7 in the developer feeding direction is set to be larger than a multiple (e.g., approximately a few times to ten times) of the pitch of the helical impeller 11*a* in the rotation axis direction, so that the amount of the developer within the wiring of the coil 6 is always substantially the same. FIG. 12 illustrates an example of the width of the flat cable 7 by a broken line. In addition, FIG. 12 illustrates an example in which the width of the flat cable 7 is set to be larger than four pitches P1 of the helical impeller 11*a* in the rotation axis direction (as illustrated in FIG. 12 by P2).

(Connection Portion 9 of Flat Cable 7)

Next, with reference to FIGS. 13 to 18, there is described a connection portion 9 to which the flat cable 7 according to the embodiment is inserted.

The flat cable 7 is wound around the cylindrical portion 101*a*, while the terminals 71*a* of the wires 71 are connected with being shifted by one pitch. The connection portion 9 (connector) is disposed outside the developer container 10. The connection portion 9 prevents the flat cable 7 from unwinding from the cylindrical portion 101*a* or connection of the terminals 71*a* from being shifted. As illustrated in FIG. 8, the connection portion 9 is disposed with an insertion port 91 for the flat cable 7 facing downward so that dust does not accumulate on the connection portion 9. In other words, the insertion port 91 faces downward.

1. Case Where the Terminals 71*a* on Both Ends of the Flat Cable 7 Face Outward First, the connection portion 9 in the case where the terminals 71*a* on the both ends of the flat cable 7 face outward so as to form the coil 6 is described.

Figure 13:
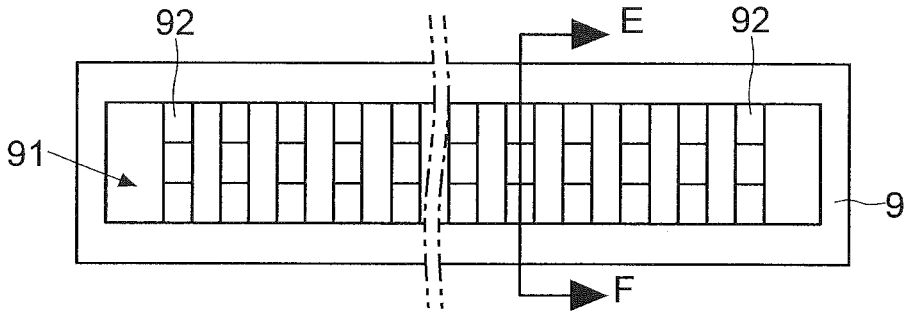
FIG. 13 illustrates an example of a connection portion in a case where terminals of the flat cable according to the embodiment face outside.

The connection portion 9 includes a case having an opened box shape (having a substantially C-shaped cross section). The opened part is the insertion port 91 for the terminals 71*a* of the flat cable 7. A plurality of metal terminals 92 are disposed in the case. In the case of the connection portion 9, there are disposed the metal terminals 92 of the number of the wires (the number of conductors) of the flat cable 7 plus one. In other words, the number of the metal terminals 92 of the connection portion 9 is greater than the number of wires (the number of conductors) included in the flat cable 7 by one. As illustrated in FIG. 13, the plurality of metal terminals 92 are arranged at constant intervals along the longitudinal direction of the connection portion 9. The end of each wire 71 of the flat cable 7 contacts with the corresponding metal terminal 92.

Figure 14:
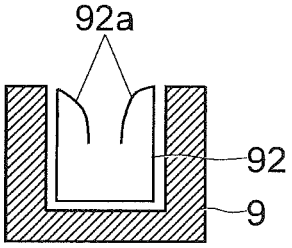
FIG. 14 is an E-F cross-sectional view of FIG. 13.

The flat cable 7 has the exposed ends on the same surface. As illustrated in FIG. 14, the terminals 71*a* of each wire are set to face outward (ends on the surface of the flat cable 7 from which the coating is not removed are contacted with each other. In this case, the metal terminal 92 is a U-shaped conductive metal plate. The ends of the metal terminal 92 are bent inward (and downward). In this way, a wire is electrically connected to a neighboring wire. A bent part 92*a* functions as a leaf spring, and thus the flat cable 7 inserted into the connection portion 9 is retained and fixed.

Figure 15:
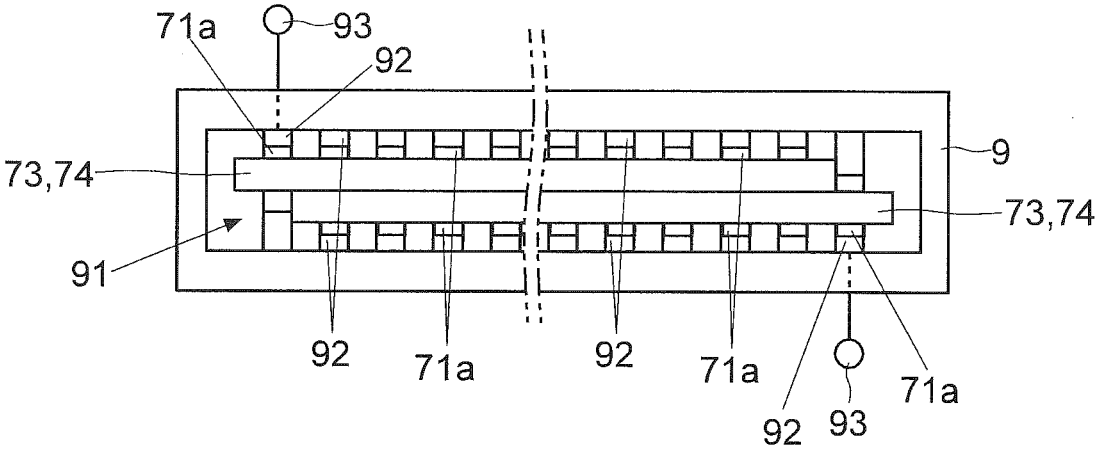
FIG. 15 illustrates an example of a state where the terminals of the flat cable according to the embodiment face outside and are inserted into the connection portion.

FIG. 15 illustrates an example of the state where the both ends of the flat cable 7 are inserted into the connection portion 9 with the terminals 71*a* of the flat cable 7 facing outward. In FIG. 15, with respect to the wires 71 of the upper side terminal part 74, the terminals 71*a* of the wires 71 of the lower side terminal part 74 are shifted to the right by one pitch. As illustrated in FIG. 15, each metal terminal 92 of the connection portion 9 contacts with the corresponding wire 71. The bent parts 92*a* of each metal terminal 92 pinch and hold the both ends of the flat cable 7. As a result, the flat cable 7 is retained in the state where the terminals 71*a* of the wires 71 are shifted by one pitch and are overlapped with each other (the terminals 71*a* of the wires 71 are shifted by one pitch and are electrically connected).

In FIG. 15, the left end terminal 71*a* of the upper side flat cable 7 and the right end terminal 71*a* of the lower side flat cable 7 correspond to both ends of the coil 6 (wound wire). The metal terminals 92 on both ends of the connection portion 9 contact with the wires corresponding to input and output terminals of the coil 6. Further, coil terminals 93 for signal input and output are led out from the metal terminals 92 on both ends of the connection portion 9 to the outside of the case of the connection portion 9. The coil terminals 93 are connected to the corresponding LC oscillation circuit 50.

Figure 16:
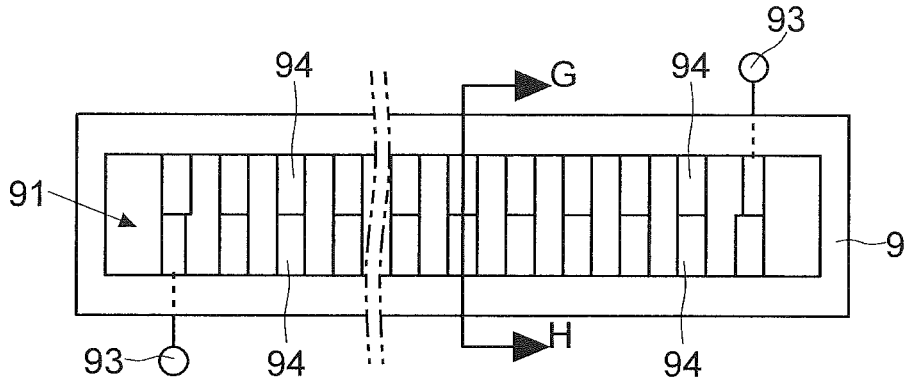
FIG. 16 illustrates an example of a connection portion in a case where the terminals of the flat cable according to the embodiment face each other.

2. Case Where the Terminals 71*a* on Both Ends of the Flat Cable 7 Face Each Other Next, the case where the terminals 71*a* on both ends of the flat cable 7 face each other is described. In this case, too, the connection portion 9 includes a case having a box shape with an opened upper surface (having a substantially C-shaped cross section). The opened part is the insertion port 91 to which the terminals 71*a* of the flat cable 7 are inserted. A plurality of metal terminals 94 are disposed in the case. In the case of the connection portion 9, there are disposed the metal terminals 94 of the number of wires (the number of conductors) of the flat cable 7 plus one. The number of the metal terminals 94 is greater than the number of wires (the number of conductors) included in the flat cable 7 by one. As illustrated in FIG. 16, the plurality of metal terminals 94 are arranged at constant intervals along the longitudinal direction of the connection portion 9.

Figure 17:
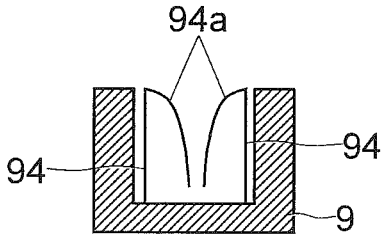
FIG. 17 is a G-H cross-sectional view of FIG. 16.

When terminals of the flat cable 7 exposed on the same surface side (exposed wires 71) are face each other with being shifted by one pitch so as to form the coil 6, a pair of vertically elongated metal plates may be the metal terminal 94. As illustrated in FIG. 17, the pair of vertically elongated metal plates is not U-shaped. The vertically elongated metal plates are bent to function as leaf springs and are arranged so that bent parts 94*a* face each other. Note that the metal terminal 94 as illustrated in FIG. 14 may be disposed in the case of the connection portion 9. This metal terminal 94 is the U-shaped conductive metal plate whose both ends are bent inward (and downward). The bent part 94*a* retains the flat cable 7 inserted into the connection portion 9 to be fixed. As a result, the terminals 71*a* are electrically connected with being shifted by one pitch (neighboring wires are electrically connected).

Figure 18:
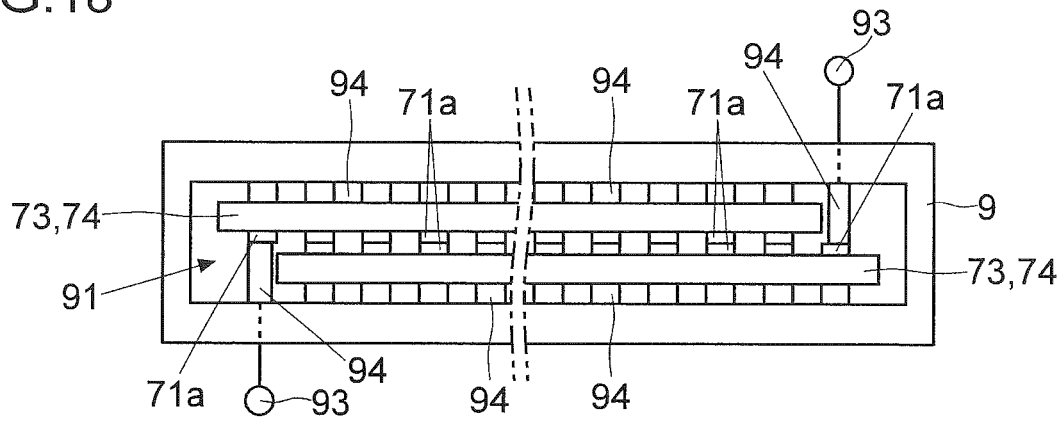
FIG. 18 illustrates an example of a state where the terminals of the flat cable according to the embodiment face each other and are inserted into the connection portion.

FIG. 18 illustrates an example of the state where the terminals 71*a* of the flat cable 7 face each other with being shifted by one pitch. FIG. 18 illustrates an example of the state where the both ends of the flat cable 7 are inserted into the connection portion 9. In FIG. 18, the both ends of the flat cable 7 are overlapped with each other. With respect to the wires 71 of the upper side terminal part 74, the wires 71 of the lower side terminal part 74 are shifted to the right by one pitch. As illustrated in FIG. 18, the metal terminals 94 except for both ends of the connection portion 9 contact with the insulation material 72 of the flat cable 7. The bent parts 94*a* of the metal terminals 94 pinch the both ends of the flat cable 7.

In FIG. 18, the left end terminal 71*a* of the upper side flat cable 7 and the right end terminal 71*a* of the lower side flat cable 7 correspond to both ends of the coil 6 (wound wire 71). The metal terminals 94 on both ends of the connection portion 9 contact with the wires corresponding to the input and output terminals of the coil 6. These metal terminals 94 are led out to the outside of the case of the connection portion 9 as the coil terminals 93 to input and output a signal. The coil terminals 93 are connected to the LC oscillation circuit 50.

In this way, the developing device 1 according to the embodiment includes the developer container 10 for storing developer containing carrier and toner, the first feeding member 11 disposed in the first compartment 101 that is one of compartments disposed in the developer container 10, so as to stir and feed the developer along with the longitudinal direction of the developer container 10, the second feeding member 12 disposed in the second compartment 102 that is the other of the compartments disposed in the developer container 10, so as to stir and feed the developer in the developer container 10 in the opposite direction to the first feeding member 11, the developing roller 13 disposed in an upper part of the developer container 10 so as to face the image carrier on which an electrostatic latent image is formed, the developing roller being supported by the developer container 10 in a rotatable manner, so as to carry the developer on the surface, and the toner density sensor 5 for detecting toner density in the developer, the sensor including the coil 6. The pair of communication portion 103 for connecting the end of the first compartment 101 to the end of the second compartment 102 is disposed on both ends in the longitudinal direction of the first compartment 101 and the second compartment 102, and the gap 8 is formed between the first compartment 101 and the second compartment 102 inside the pair of communication portion 103 in the longitudinal direction. A part of the first compartment 101 adjacent to the gap 8 is the cylindrical portion 101*a* through which the first feeding member 11 and the developer pass. The coil 6 is the flat cable 7. The flat cable 7 passes through the gap 8 and is wound around the cylindrical portion 101*a* so as to form a winding by overlapping the both ends of the flat cable 7 in a state where the terminals 71*a* of the wires 71 are shifted by one pitch.

In this way, the flat cable 7 can be used as the coil 6 only by a simple work of setting the flat cable 7 to pass through the gap 8 and to be wound around the cylindrical portion 101*a*. Because the developer passes through the cylindrical portion 101*a*, the magnetic carrier in the developer becomes a core of the coil 6 using the flat cable 7, and hence a sufficient inductance value can be obtained. Therefore, a variation of the carrier density corresponding to the core can be detected with good sensitivity so that the toner density can be accurately detected. In addition, by using an inexpensive flat cable 7, cost necessary for the toner density sensor 5 can be reduced. In addition, by changing the number of wires included in the flat cable 7 (the number of conductors, the width of the cable), it is easy to obtain the coil 6 having the inductance and the number of turns appropriate for the toner density detection.

In addition, the connection portion 9 including the insertion port 91 to which the terminals of the wires 71 of the flat cable 7 are inserted is disposed outside the developer container 10. The flat cable 7 has the terminals of the wires 71 exposed on the same surface side. The number of terminals of the connection portion 9 is greater than the number of wires (the number of conductors) of the flat cable 7 by one. The connection portion 9 includes the coil terminals 93 that retain the both end portions 73 of the flat cable 7 in the state where the terminals 71*a* of the wires 71 are overlapped with being shifted by one pitch, and contact with the terminals of the wires 71 of the flat cable 7 corresponding to both ends of the coil 6.

In this way, the flat cable 7 can be used as the coil 6 only by shifting the terminals 71*a* of the flat cable 7 by one pitch and connecting the flat cable 7 to the connection portion 9. Only by inserting the both ends of the flat cable 7 into the connection portion 9, the coil 6 is formed. Thus, the flat cable 7 wound around the cylindrical portion 101*a* can be easily fixed at a low cost. In addition, the coil 6 can be exchanged only by replacing the flat cable 7.

In addition, the connection portion 9 is disposed so that the insertion port 91 of the flat cable 7 faces downward. The work is only appropriately adjusting the end portions 73 of the flat cable 7 and inserting the ends of the flat cable 7 upward. Dust such as toner is floating in the apparatus. However, a contact failure or a short circuit between the wires 71 of the flat cable 7 does not occur due to the dust accumulated on the insertion port 91.

By movements of the helical impeller 11*a*, the height of the developer in the cylindrical portion 101*a* waves (rolls) in the rotation axis direction of the first feeding member 11. In other words, stirring and feeding by the helical impeller 11*a* cause a periodical variation of the height of the developer in the cylindrical portion 101*a* in the rotation axis direction. In other words, in the cylindrical portion 101*a*, the developer has sparse and dense in the amount in the rotation axis direction. Here, it is experimentally known that a pitch of the wave corresponds to the pitch of the helical impeller 11*a* in the rotation axis direction.

Accordingly, the first feeding member 11 has the helical impeller 11*a* formed on the outer circumferential surface of the rotation shaft. The width of the flat cable 7 in the developer feeding direction is set to be larger than a multiple of the pitch of the helical impeller 11*a* in the rotation axis direction. In this way, even if the developer has sparse and dense in the amount in the rotation axis direction of the first feeding member 11 in the cylindrical portion 101*a*, an amount of the developer within the coil 6 of the flat cable 7 is hardly changed substantially. Therefore an influence of the wave to a toner density detection result can be reduced. The toner density can be accurately detected.

In addition, the toner density sensor 5 includes an oscillation circuit having the flat cable 7 as the coil 6. The developing device 1 includes a control unit (the engine control unit 40) that recognizes the toner density in the developer based on a frequency of the oscillation circuit. In this way, cost of the toner density sensor 5 including the oscillation circuit can be reduced. The toner density can be accurately detected.

In addition, the image forming apparatus (the printer 100) includes the developing device 1 described above. Because a variation of the toner density can be accurately detected with good sensitivity, the toner density in the developer can be always accurately maintained, and an image forming apparatus having high image quality can be provided. In addition, because cost of the developing device 1 can be reduced, it is possible to provide an inexpensive and high performance image forming apparatus.

The embodiment of the present disclosure is described above. The scope of the present disclosure is not limited to this embodiment. The present disclosure can be variously modified within the scope not deviating from the spirit of the disclosure.

What is claimed is:

1. A developing device comprising:

a developer container for storing developer containing carrier and toner;

a first feeding member disposed in a first compartment that is one of compartments disposed in the developer container, so as to stir and feed the developer along with a longitudinal direction of the developer container;

a second feeding member disposed in a second compartment that is the other of the compartments disposed in the developer container, so as to stir and feed the developer in the developer container in the opposite direction to the first feeding member;

a developing roller disposed in an upper part of the developer container so as to face an image carrier on which an electrostatic latent image is formed, the developing roller being supported by the developer container in a rotatable manner, so as to carry the developer on a surface; and a toner density sensor for detecting toner density in the developer, the sensor including a coil, wherein a pair of communication portion for connecting an end of the first compartment to an end of the second compartment is disposed on both ends in the longitudinal direction of the first compartment and the second compartment, a gap is formed between the first compartment and the second compartment inside the pair of communication portion in the longitudinal direction, a part of the first compartment adjacent to the gap is a cylindrical portion through which the first feeding member and the developer pass, the coil is a flat cable, and the flat cable passes through the gap and is wound around the cylindrical portion so as to form a winding by overlapping both end portions of the flat cable in a state where terminals of wires are shifted by one pitch.

2. The developing device according to claim 1, wherein a connection portion including an insertion port to which the terminals of the flat cable are inserted is disposed outside the developer container, the flat cable has the terminals exposed on the same surface side, the number of terminals of the connection portion is greater than the number of wires of the flat cable by one, and the connection portion retains both end portions of the flat cable in the state where the terminals of the wires are overlapped with being shifted by one pitch, and includes coil terminals that contact with the terminals of the flat cable corresponding to both ends of the coil.

3. The developing device according to claim 2, wherein the connection portion includes metal terminals disposed in a case, the metal terminals being U-shaped conductive metal plates with both ends bent inward, and bent parts of the metal terminals retain the flat cable inserted into the connection portion in a state where the terminals of the wires face outward.

4. The developing device according to claim 2, wherein the connection portion includes metal terminals each of which is a pair of vertically elongated metal plates bent so that bent parts face each other, and the bent parts of the metal terminals retain the flat cable inserted in a state where the terminals of the flat cable face each other.

5. The developing device according to claim 2, wherein the connection portion is disposed so that the insertion port for the flat cable faces downward.

6. The developing device according to claim 1, wherein the first feeding member includes a helical impeller formed on an outer circumferential surface of a rotation shaft, and a width of the flat cable in a developer feeding direction is larger than a multiple of a pitch of the helical impeller in a rotation axis direction.

7. The developing device according to claim 1, wherein the toner density sensor includes an oscillation circuit having the flat cable as the coil, and the developing device includes a control unit for recognizing toner density in the developer based on a frequency of the oscillation circuit.

8. An image forming apparatus comprising the developing device according to claim 1.

9. A method of attaching a coil of a developing device, the method comprising:

storing developer containing carrier and toner in a developer container;

stirring and feeding the developer along a longitudinal direction of the developer container by a first feeding member disposed in a first compartment that is one of compartments disposed in the developer container;

stirring and feeding the developer in the developer container in the opposite direction to the first feeding member by a second feeding member disposed in a second compartment that is the other of the compartments disposed in the developer container;

carrying the developer on a surface of the developing roller disposed in an upper part of the developer container so as to face an image carrier on which an electrostatic latent image is formed, the developing roller being supported by the developer container in a rotatable manner;

allowing the toner density sensor including a coil to detect toner density in the developer;

connecting an end of the first compartment to an end of the second compartment via a pair of communication portion disposed on both ends in the longitudinal direction of the first compartment and the second compartment;

forming a gap between the first compartment and the second compartment inside the pair of communication portion in the longitudinal direction, so as to use a part of the first compartment adjacent to the gap as a cylindrical portion through which the first feeding member and the developer pass;

using a flat cable as the coil; and making the flat cable pass through the gap and be wound around the cylindrical portion so as to form a winding by overlapping both end portions of the flat cable in a state where terminals of wires are shifted by one pitch.

* * * * *